US010696467B2

(12) United States Patent
Moon

(10) Patent No.: US 10,696,467 B2
(45) Date of Patent: Jun. 30, 2020

(54) COOLER BOX AND MANUFACTURING METHOD THEREOF

(71) Applicant: FTI GROUP (HOLDING) COMPANY LIMITED, Grand Cayman (KY)

(72) Inventor: Jerry Moon, Taipei (TW)

(73) Assignee: FTI GROUP (HOLDING) COMPANY LIMITED, Grand Cayman (KY)

( * ) Notice: Subject to any disclaimer, the term of this patent is extended or adjusted under 35 U.S.C. 154(b) by 98 days.

(21) Appl. No.: 16/036,098

(22) Filed: Jul. 16, 2018

(65) Prior Publication Data

US 2020/0017277 A1 Jan. 16, 2020

(51) Int. Cl.

| | |
|---|---|
| ***B65D 81/38*** | (2006.01) |
| *F25D 23/06* | (2006.01) |
| *F25D 3/08* | (2006.01) |

(52) U.S. Cl.

CPC ..... *B65D 81/3818* (2013.01); *F25D 3/08* (2013.01); *F25D 23/065* (2013.01)

(58) Field of Classification Search

CPC .... B65D 81/00–3818; B65D 13/00–04; B65D 15/00–24; B65D 7/00–48; F25D 23/00–065; F25D 3/00–08

See application file for complete search history.

(56) References Cited

U.S. PATENT DOCUMENTS

| | | | | | |
|---|---|---|---|---|---|
| 2,347,192 | A * | 4/1944 | Grice | A45C 5/04 | 190/19 |
| 2,743,029 | A * | 4/1956 | Mautner | B65D 7/12 | 217/56 |
| 2,980,285 | A * | 4/1961 | Parsons | B65D 7/12 | 220/668 |
| 3,561,634 | A * | 2/1971 | Meldrum | B65D 88/12 | 220/1.5 |
| 3,730,309 | A * | 5/1973 | Hamann | A45C 5/00 | 190/127 |
| 3,989,157 | A * | 11/1976 | Veenema | B65D 9/34 | 220/4.28 |
| 4,271,975 | A * | 6/1981 | Ketner | B65D 88/121 | 217/65 |
| 4,319,629 | A * | 3/1982 | Hotta | A45C 11/20 | 126/400 |

(Continued)

*Primary Examiner* — Kareen K Thomas

(74) *Attorney, Agent, or Firm* — Rabin & Berdo, P.C.

(57) ABSTRACT

A cooler box includes a body portion and a cover portion pivotally turnably connected to each other via a hinge structure. The body portion has a storage opening and internally defines a storage space communicable with the storage opening; and includes, from an outer to an inner side, an outer shell, an insulation layer and an inner shell. The body portion further includes a binding frame assembled to an upper end thereof. The binding frame includes two substantially parallelly extended clamping wall portions, which together inwardly clamp on the outer shell, the insulation layer and the inner shell, such that the insulation layer is fixedly held in an enclosed space defined in between the binding frame, the outer shell and the inner shell. With the binding frame, different components of the cooler box can be more easily assembled together to reduce the assembling time and increase the productivity.

7 Claims, 17 Drawing Sheets

(56) References Cited

U.S. PATENT DOCUMENTS 4,558,797 A * 12/1985 Mitchell ..... B65D 90/08 220/1.5
4,998,636 A * 3/1991 Hardigg ..... B65D 81/07 220/4.34
5,000,301 A * 3/1991 Grenier ..... A45C 5/02 190/127
5,050,387 A * 9/1991 Bruce ..... F25D 3/06 62/438
5,429,259 A * 7/1995 Robin ..... B65D 9/06 217/65
5,435,142 A * 7/1995 Silber ..... B01L 3/508 422/939
5,562,228 A * 10/1996 Ericson ..... A45C 7/0077 62/457.2
5,924,302 A * 7/1999 Derifield ..... B65D 81/3862 62/371
5,979,693 A * 11/1999 Bane, III ..... B65D 81/3825 220/23.9
5,996,828 A * 12/1999 Cheyn ..... B65D 11/1873 220/4.31
7,422,143 B2 * 9/2008 Mayer ..... B65D 81/3816 220/592.2
7,908,870 B2 * 3/2011 Williams ..... F25D 3/08 62/62
8,196,758 B2 * 6/2012 Lee ..... A47B 47/03 211/26
8,689,992 B2 * 4/2014 Anderson ..... A47C 7/62 217/12 R
2004/0174106 A1 * 9/2004 Uekado ..... F25D 23/062 312/401
2009/0032530 A1 * 2/2009 Chu ..... B65D 88/121 220/4.28
2018/0186511 A1 * 7/2018 Sullivan ..... B65D 7/24
2019/0367263 A1 * 12/2019 Chabot ..... B65D 90/0053

* cited by examiner

COOLER BOX AND MANUFACTURING METHOD THEREOF

FIELD OF THE INVENTION

The present invention relates to a cooler box and a manufacturing method thereof; and more particularly, to a cooler box and a manufacturing method thereof that provide an improved way of connecting different components of the cooler box, so that the cooler box can be manufactured with effectively reduced assembling time.

BACKGROUND OF THE INVENTION

Many people are interested in fishing and camping. Generally, a fishing lover or a camping lover would carry a cooler box along with him or her for storing fish caught or food and/or beverage. Most of the currently available cooler boxes are manufactured by preparing an outer shell, an insulation layer and an inner shell. The insulation layer and the inner shell are sequentially positioned on an inner side of the outer shell, such that the insulation layer is located between the outer shell and the inner shell. Then, the outer shell, the insulation layer and the inner layer are sewn together using a tool or a machine.

In the process of sewing the outer shell, the insulation layer and the inner layer together, a handling worker has to simultaneously firmly grip on the outer shell, the insulation layer and the inner shell with two hands all the time, lest the outer shell, the insulation layer and the inner shell should become dislocated during the sewing process. In the event the outer shell, the insulation layer and the inner shell are dislocated, it is possibly they could not be firmly connected to one another and additional time is required to rework the cooler box and sew the outer shell, the insulation layer and the inner shell together again. In brief, in the past, the components of the cooler box are connected in a way that could not shorten the assembling time to thereby adversely affect the productivity of the cooler box.

SUMMARY OF THE INVENTION

A primary object of the present invention is to improve the way of assembling different components of a cooler box to lower the difficulty in forming the cooler box, so that the cooler box can be manufactured with reduced assembling time and in increased production efficiency.

To achieve the above and other objects, the present invention provides a cooler box that includes a body portion, a cover portion and a hinge structure. The body portion has a storage opening and internally defines a storage space communicable with the storage opening. The body portion includes an inner shell formed in the storage space, an insulation layer located outside the inner shell, and an outer shell located outside the insulation layer. The cover portion is pivotally turnably connected to the body portion via a hinge structure, such that the cover portion covers the storage opening to close the storage space.

The body portion further includes a binding frame assembled to an upper end thereof. The binding frame includes a connecting loop portion and an inner and an outer clamping wall portion substantially parallelly extending along two opposite lateral edges of the connecting loop portion. The two clamping wall portion together inwardly clamp on the outer shell, the insulation layer and the inner shell while the connecting loop portion is located around the storage opening, such that the insulation layer is fixedly held in an enclosed space defined in between the connecting loop portion, the outer shell and the inner shell.

According to a preferred embodiment of the present invention, a thickness of an outer wall portion of the outer shell, a thickness of the insulation layer and a thickness of an inner wall portion of the inner shell together define an assembled thickness of the body portion; and the inner and the outer clamping wall portion of the binding frame together define between them a bound thickness, which is smaller than or equal to the assembled thickness. Further, the binding frame is made of an elastic material, such that the inner and outer clamping wall portions of the binding frame are deformable to move away from each other when the binding frame is assembled to the upper end of the body portion around the storage opening.

The hinge structure includes at least one hinge member. The hinge member includes two leaves pivotally turnably connected to each other. One of the two leaves is fixed to the body portion by a plurality of insertion pins that are extended sequentially through the outer clamping wall portion of the binding frame, the outer shell, the insulation layer, the inner shell and the inner clamping wall portion of the binding frame.

To achieve the above and other objects, the present invention also provides a cooler box manufacturing method, which includes an outer shell forming step, a storage compartment forming step, a body portion forming step, and a cooler box forming step.

In the outer shell forming step, a panel is heated and becomes softened and deformable, and the softened and deformable panel is subjected to a vacuum suction operation to form the outer shell. In a preferred embodiment of the cooler box manufacturing method according to the present invention, the panel is heated and softened in a processing environment of 150-200° C.

In the storage compartment forming step, an insulation layer and an inner shell are sequentially positioned on an inner side of the outer shell to form a storage compartment, which internally defines a storage space and has a storage opening. In the body portion forming step, a binding frame having a connecting loop portion and an inner and an outer clamping wall portion substantially parallelly extended along two opposite lateral edges of the connecting loop portion is assembled to an upper end of the storage compartment, such that the inner and the outer clamping wall portion together clamp on the outer shell, the inner shell and the insulation layer while the connecting loop portion is located around the storage opening, bringing the storage compartment and the binding frame to assemble to each other to form a body portion for a cooler box with the insulation layer fixedly held in an enclosed space defined in between the connecting loop portion, the outer shell and the inner shell. Finally, in the cooler box forming step, a cover portion is pivotally turnably connected to the body portion via a hinge structure to complete a cooler box.

The cooler box manufactured according to the method of the present invention is characterized in that the binding frame is assembled to the upper end of the storage compartment with the two clamping wall portions inwardly clamping on the outer wall portion, the inner wall portion and the insulation layer, such that the outer shell, the inner shell, the insulation layer and the binding frame are assembled together to fixedly hold the insulation layer in the enclosed space defined in between the connecting loop portion of the binding frame, the outer shell and the inner shell. In this way, different components of the cooler box can be connected in an improved and easier manner to effectively reduce the assembling time thereof and accordingly, increase the production efficiency of the cooler box.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

The present invention will now be described with a preferred embodiment thereof and by referring to the accompanying drawings.

Figure 1:
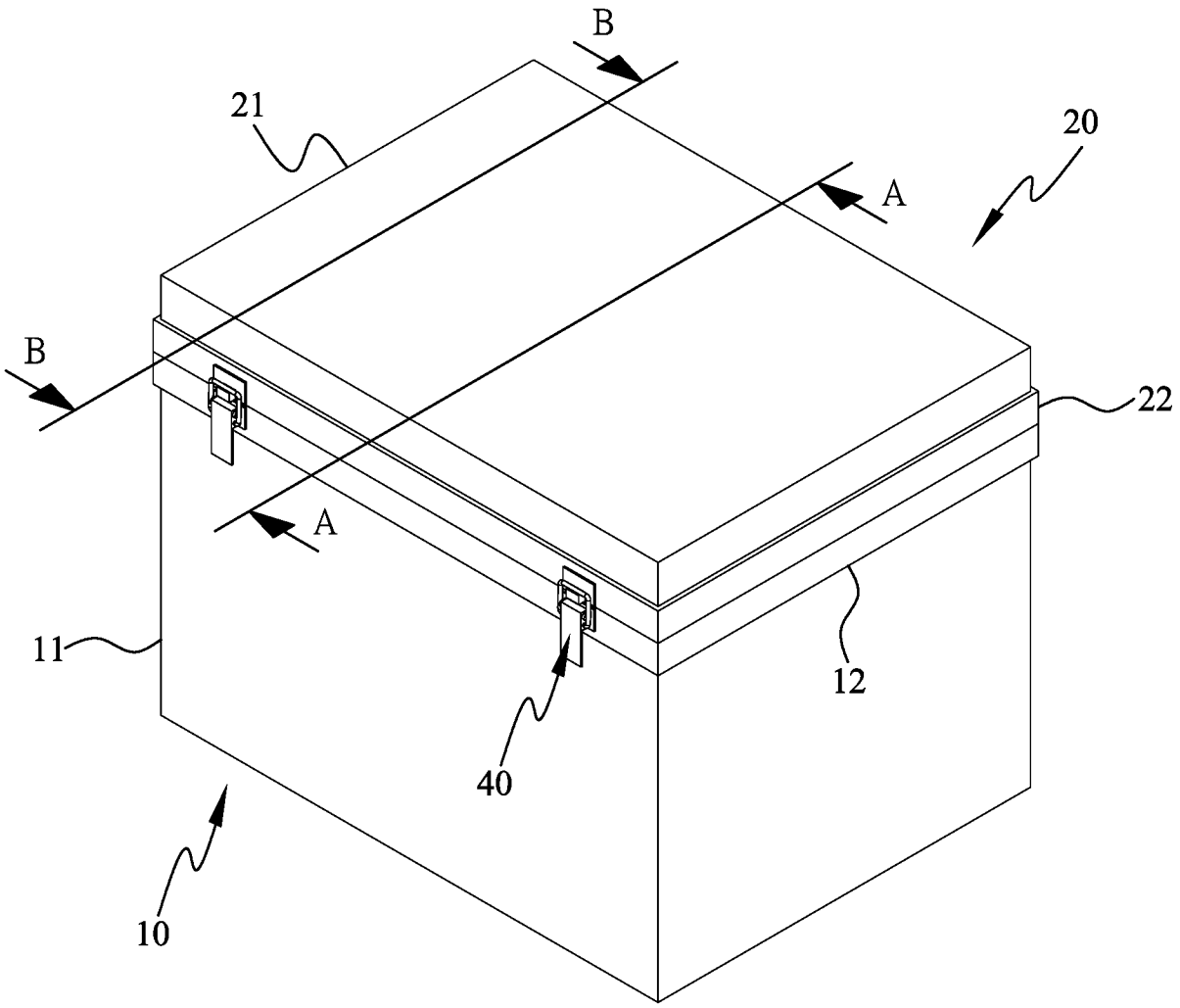
FIG. 1 is an assembled perspective view of a cooler box according to a preferred embodiment of the present invention.
Figure 2:
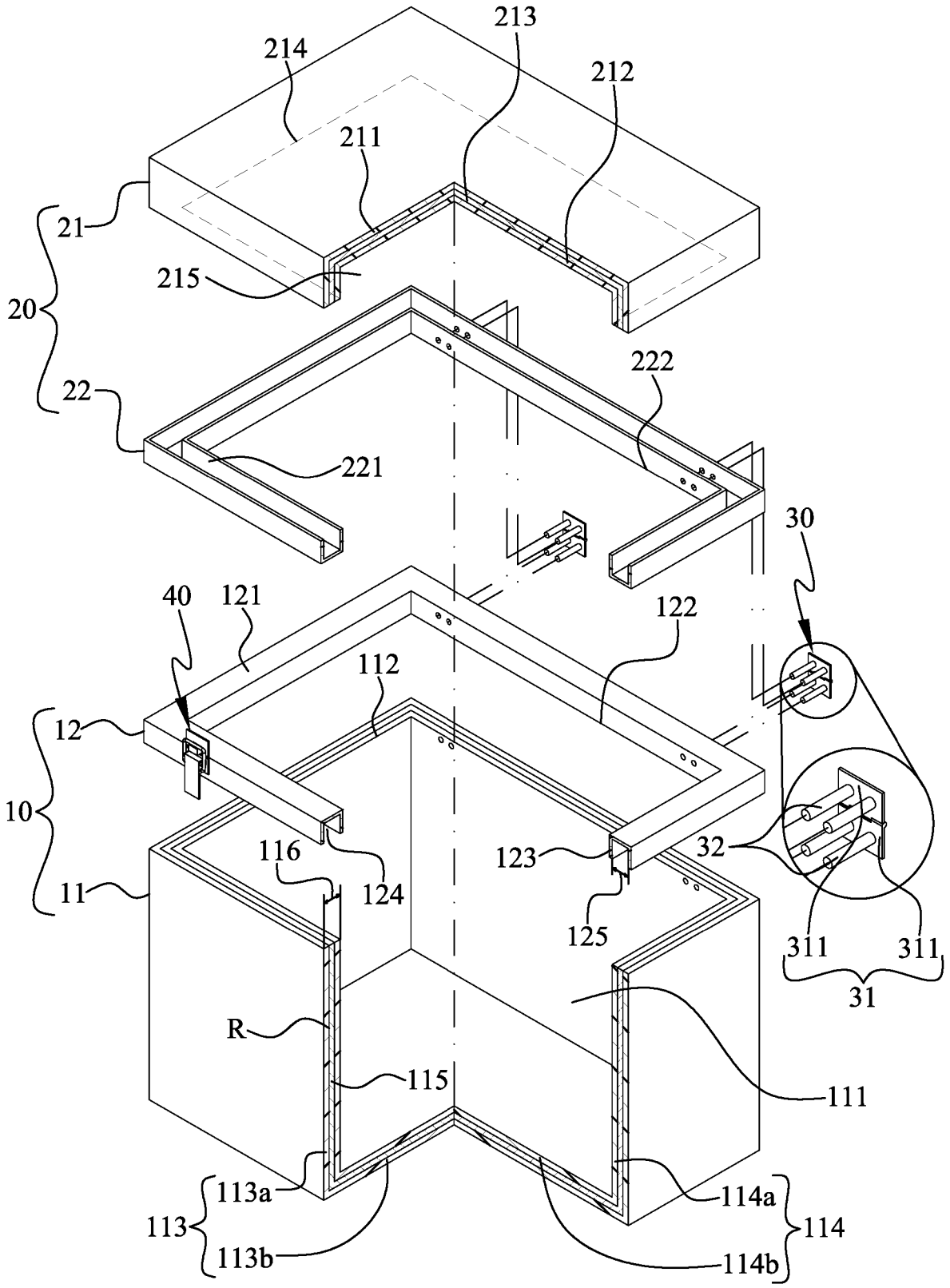
FIG. 2 is an exploded view of FIG. 1.

Please refer to FIGS. 1 and 2. A cooler box according to a preferred embodiment of the present invention includes a body portion 10, a cover portion 20, a hinge structure 30, and a fastening structure 40. The body portion 10 is formed of a three-dimensional storage compartment 11 and a binding frame 12 assembled to an upper end of the storage compartment 11. The storage compartment 11 internally defines a storage space 111, which is communicable with a storage opening 112 formed at the upper end of the storage compartment 11.

Figure 3:
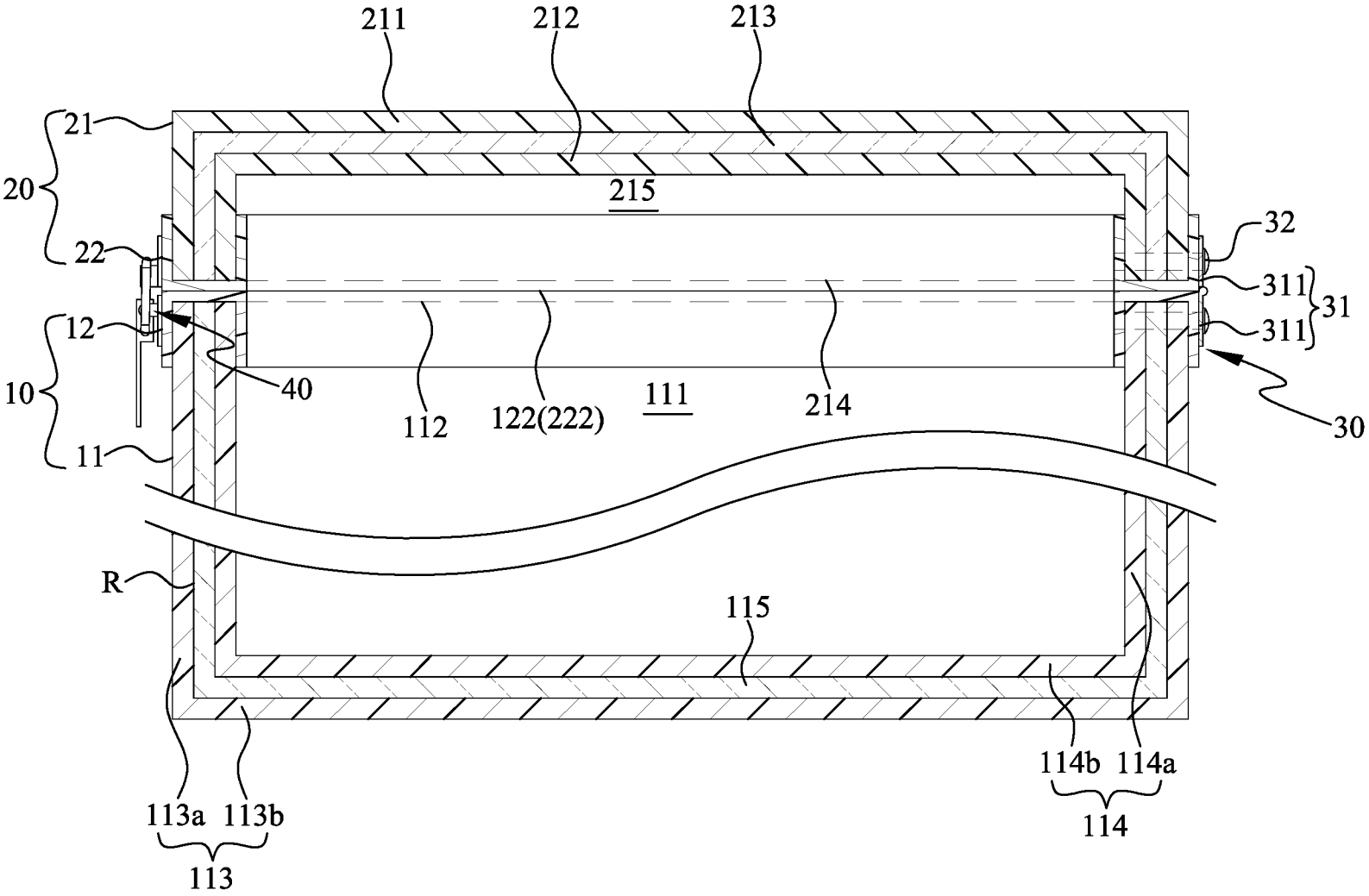
FIG. 3 is a sectional view taken along line A-A of FIG. 1.

Please refer to FIGS. 2 and 3. According to the preferred embodiment, the storage compartment 11 has an outermost layer in the form of a three-dimensional outer shell 113, and an innermost layer being an inner shell 114 having a three-dimensional configuration smaller than the outer shell 113. In the preferred embodiment, it is the inner shell 114 that internally defines the storage space 111. The outer shell 113 can be made of an acrylonitrile butadiene styrene (ABS) resin exclusively or made of a polycarbonate (PC) resin exclusively. Alternatively, the outer shell 113 can be otherwise made of an ABS resin and a PC resin. In the later case, the outer shell 113 has an outermost side formed of the PC resin and an innermost side formed of the ABS resin. On the other hand, the inner shell 114 can be made of a polypropylene (PP) resin or a polyethylene (PE) resin.

As shown in FIGS. 2 and 3, the outer shell 113 includes a continuous outer wall portion 113*a* in the form of a hollow column, and an outer base portion 113*b* integrally formed with and located at a lower side of the outer wall portion 113*a*; and the inner shell 114 includes a continuous inner wall portion 114*a* having dimensions smaller than the outer wall portion 113*a* and an inner base portion 114*b* integrally formed with and located at a lower side of the inner wall portion 114*a*. The inner shell 114 is fitted in the outer shell 113 with a space remained between the inner wall portion 114*a* and the outer wall portion 113*a* and between the inner base portion 114*b* and the outer base portion 113*b*, such that an insulation layer 115 can be disposed between the outer shell 113 and the inner shell 114 for temperature loss protection. Therefore, the storage space 111 is enclosed by, from an inner side to an outer side, the inner shell 114, the insulation layer 115 and the outer shell 113. As can be seen in FIG. 3, when the inner shell 114 is fitted in the outer shell 113, an upper end of the inner wall portion 114*a* distant from the inner base portion 114*b* is flush with an upper end of the outer wall portion 113*a* distant from the outer base portion 113*b*. Further, a thickness of the outer wall portion 113*a*, a thickness of the inner wall portion 114*a* and a thickness of the insulation layer 115 together define an assembled thickness 116 (see FIG. 2) of the storage compartment 11.

Please refer to FIG. 2 again. The binding frame 12 is made of an elastic material, and includes a connecting loop portion 121 defining a central opening 122 and an outer and an inner clamping wall portion 123 substantially parallelly extending along two opposite lateral edges of the connecting loop portion 121, such that the connecting loop portion 121 and the two clamping wall portions 123 together define a binding space 124 in between them. More specifically, the inner and the outer clamping wall portion 123 together define a bound thickness 125 between them, and the bound thickness 125 is smaller than or equal to the assembled thickness 116. In the illustrated preferred embodiment, the binding frame 12 can be made of a PP resin or a PE resin. In the case the binding frame 12 is made of a PE resin, the selected PE resin is preferably a high-density polyethylene (HDPE) or a linear low-density polyethylene (LLDPE) resin.

Figure 4:
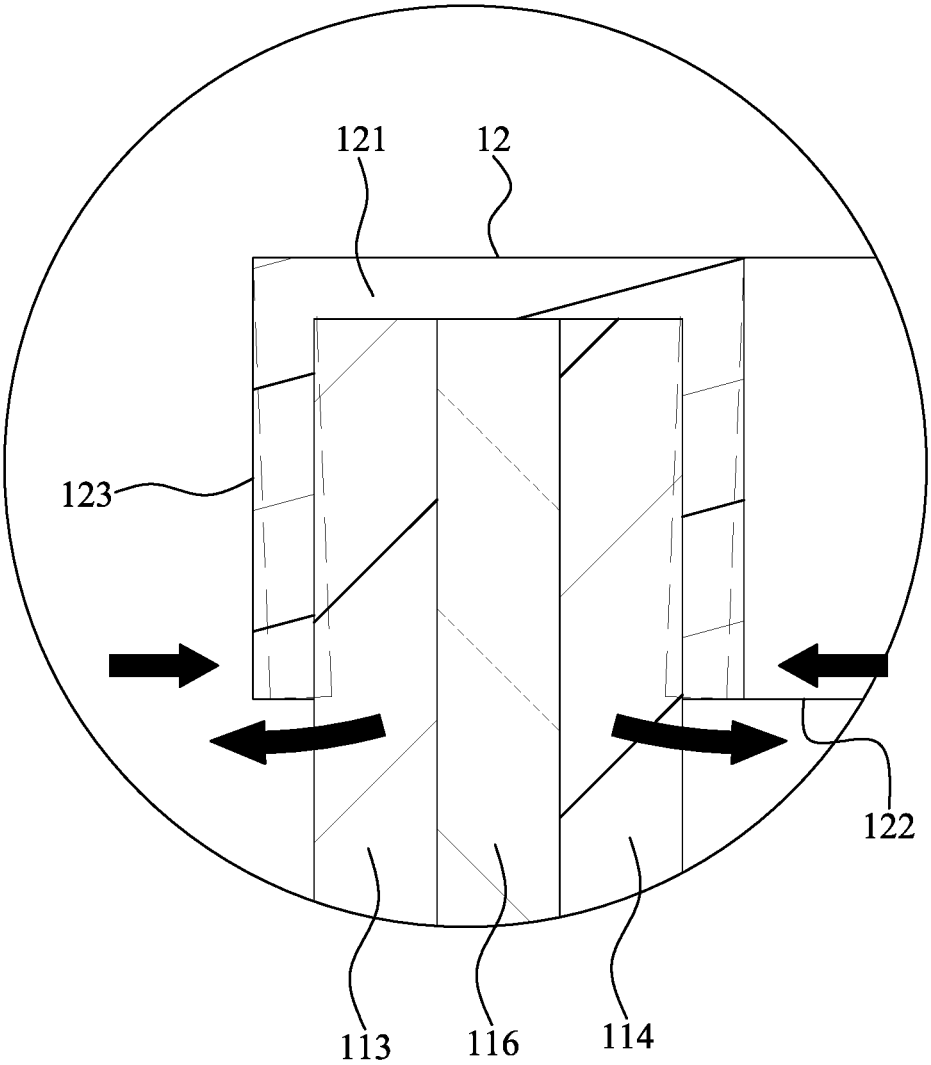
FIG. 4 is an enlarged, fragmentary view showing the assembling of a binding frame to a storage compartment of the cooler box of the present invention.

Please refer to FIGS. 3 and 4. The binding frame 12 is assembled to the upper end of the storage compartment 11 with the connecting loop portion 121 located around the storage opening 112, such that the central opening 122 of the binding frame 12 is communicable with the storage space 111 via the storage opening 112. In the illustrated preferred embodiment, when the binding frame 12 is assembled to the storage compartment 11 and located around the storage opening 112, the outer wall portion 113*a* of the outer shell 113, the insulation layer 115 and the inner wall portion 114*a* of the inner shell 114 respectively have a length adjacent to their upper ends being received in the binding space 124 of the binding frame 12, and the upper ends of the outer wall portion 113*a* of the outer shell 113, the insulation layer 115 and the inner wall portion 114*a* of the inner shell 114 closer to the storage opening 112 all are in contact with the connecting loop portion 121 of the binding frame 12. At this point, since the bound thickness 125 is smaller than or equal to the assembled thickness 116, the inner and the outer clamping wall portion 123 of the binding frame 12 tend to deform and separate from each other while generating an inward clamping force against the outer wall portion 113*a*, the inner wall portion 114*a* and the insulation layer 115, bringing the outer shell 113, the inner shell 114, the connecting loop portion 121 and the inner and outer clamping wall portions 123 to together constitute an enclosed space R, in which the insulation layer 115 is fixedly held.

Please refer back to FIGS. 2 and 3. The cover portion 20 is configured as a three-dimensional structure having a size smaller than that of the body portion 10 and is located on a top of the body portion 10. The cover portion 20 includes a three-dimensional cover storage compartment 21 and a cover binding frame 22 assembled to a lower end of the cover storage compartment 21. The cover storage compartment 21 is structurally similar to the storage compartment 11 of the body portion 10 and is formed at the lower end with a cover storage opening 214 and internally defines a cover storage space 215. More specifically, the cover storage compartment 21 includes a cover outer shell 211 and a cover inner shell 212, which are similar to the outer shell 113 and the inner shell 114 of the storage compartment 11, respectively, in terms of the forming materials and the structures thereof. Similarly, a cover insulation layer 213 is disposed between the cover outer shell 211 and the cover inner shell 212 to provide the same function as the insulation layer 115.

The cover binding frame 22 is structurally similar to the binding frame 12 of the body portion 10 for assembling to the lower end of the cover storage compartment 21, and includes an inner and an outer cover clamping wall portion 221 for together clamping on the cover outer shell 211, the cover inner shell 212 and the cover insulation layer 213. The cover binding frame 22 also defines a cover central opening 222, which is communicable with the cover storage space 215 defined in the cover storage compartment 21 via the cover storage opening 214 of the cover storage compartment 21.

Figure 5:
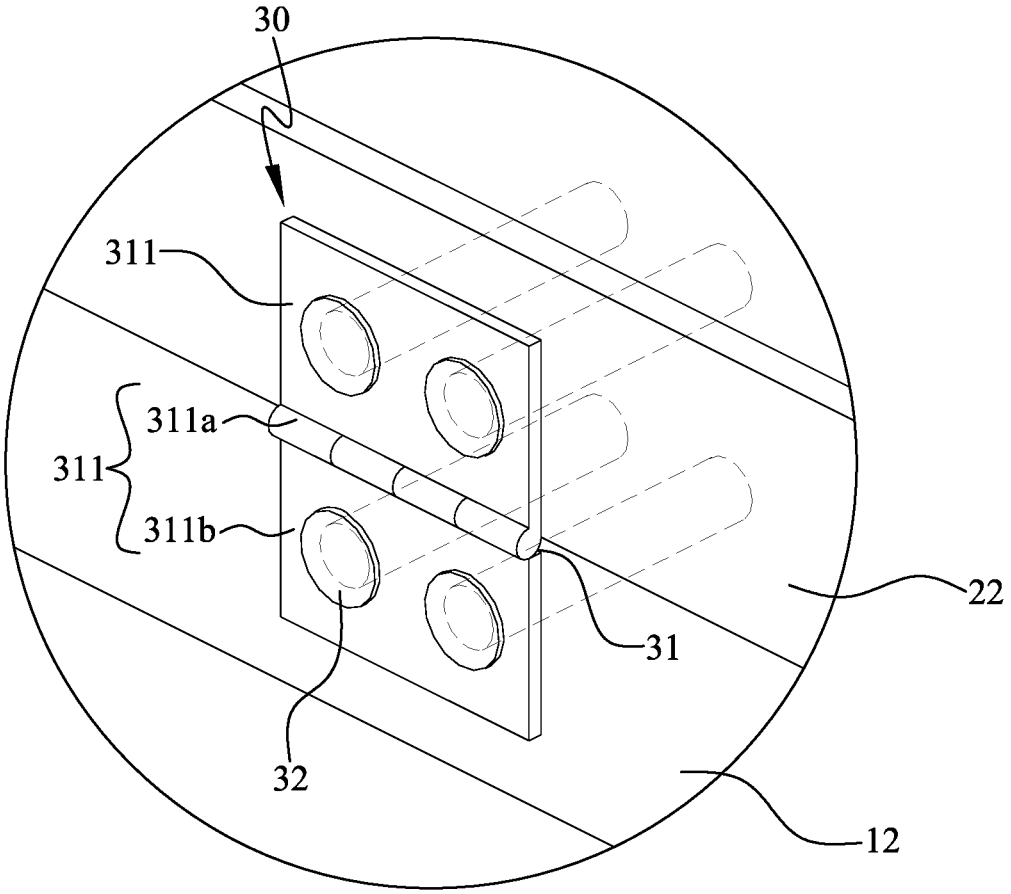
FIG. 5 is an enlarged, fragmentary view showing the assembling of a hinge structure to a body portion and a cover portion of the cooler box of the present invention.

Please refer to FIGS. 2 and 5. The hinge structure 30 is mounted to between the body portion 10 and the cover portion 20, and includes two hinge members 31 and a plurality of insertion pins 32. Each of the hinge members 31 includes two structurally identical leaves 311. The leaves 311 respectively have a part forming a pivotal portion 311*a* and another part forming a perforated plate portion 311*b*. The pivotal portion 311*a* of one of the two leaves 311 is rotatably connected to the pivotal portion 311*a* of the other leaf 311, such that the perforated plate portions 311*b* of the two leaves 311 are pivotally turnable relative to each other via the rotatable connection of the two pivotal portions 311*a* to selectively move toward or away from each other.

Figure 6:
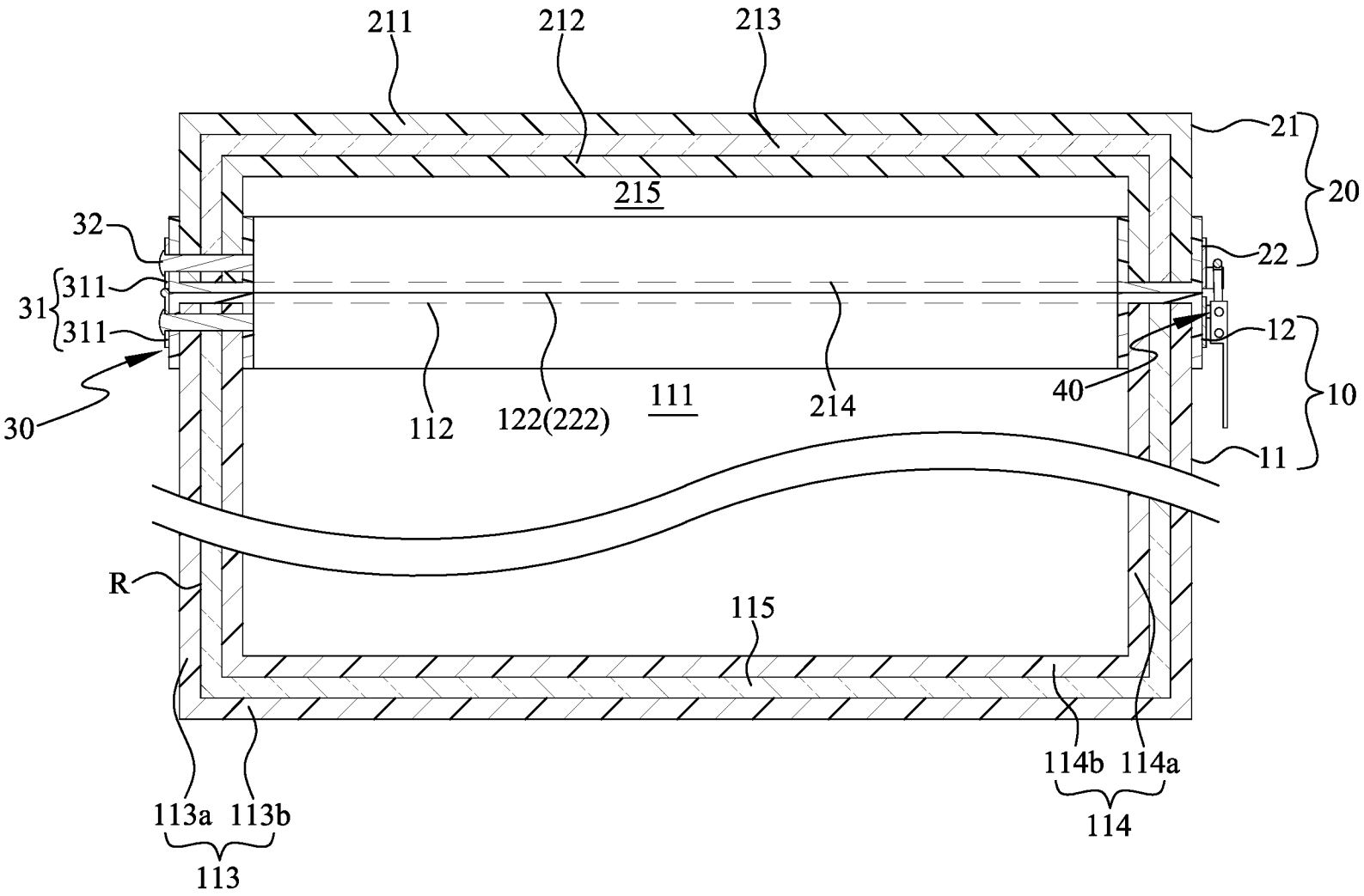
FIG. 6 is a sectional view taken along line B-B of FIG. 1.

Please refer to FIGS. 5 and 6. One of the two leaves 311 of each hinge member 31 is located on a rear side of the body portion 10 with a part of the insertion pins 32 extended through the perforated plate portion 311*b* of the leaf 311, such that the insertion pins 32 further sequentially extend through the outer clamping wall portion 123 of the binding frame 12, the outer wall portion 113*a* of the outer shell 113, the insulation layer 115, the inner wall portion 114*a* of the inner shell 114, and the inner clamping wall portion 123 of the binding frame 12. In this manner, the outer shell 113, the insulation layer 115, the inner shell 114 and the binding frame 12 are tightly bound together without being easily separated from one another, and the leaf 311 is fixedly held to the rear side of the body portion 10 by the insertion pins 32.

Figure 7:
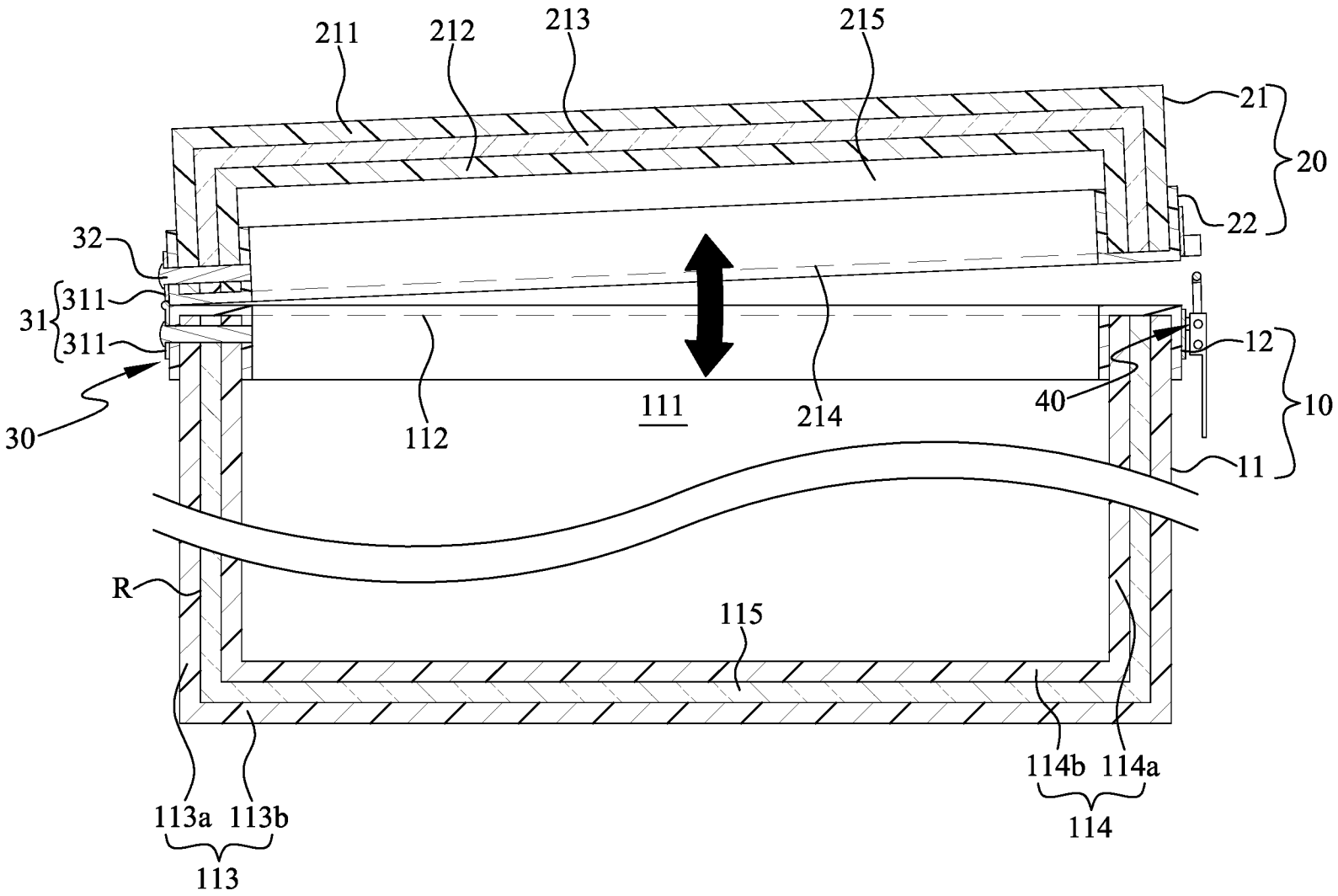
FIG. 7 is a sectional view showing the cover portion is pivotally turnable relative to the body portion of the cooler box of the present invention.

The other leaf 311 of each hinge member 31 is located on a rear side of the cover portion 20 with the other part of the insertion pins 32 extended through the perforated plate portion 311*b* of the other leaf 311, such that the other insertion pins 32 further sequentially extend through the outer cover clamping wall portion 221 of the cover binding frame 22, the cover outer shell 211, the cover insulation layer 213, the cover inner shell 212, and the inner cover clamping wall portion 221 of the cover binding frame 22. In this manner, the other leaf 311 of each hinge member 31 is fixedly held to the rear side of the cover portion 20 by the other insertion pins 32. Further, as can be seen in FIG. 7, since the two leaves 311 of each of the two hinge members 31 are rotatably connected to each other, the cover portion 20 connected to the body portion 10 can be pivotally turned relative to the body portion 10 to selectively close or expose the storage opening 112 of the body portion 10.

Figure 8:
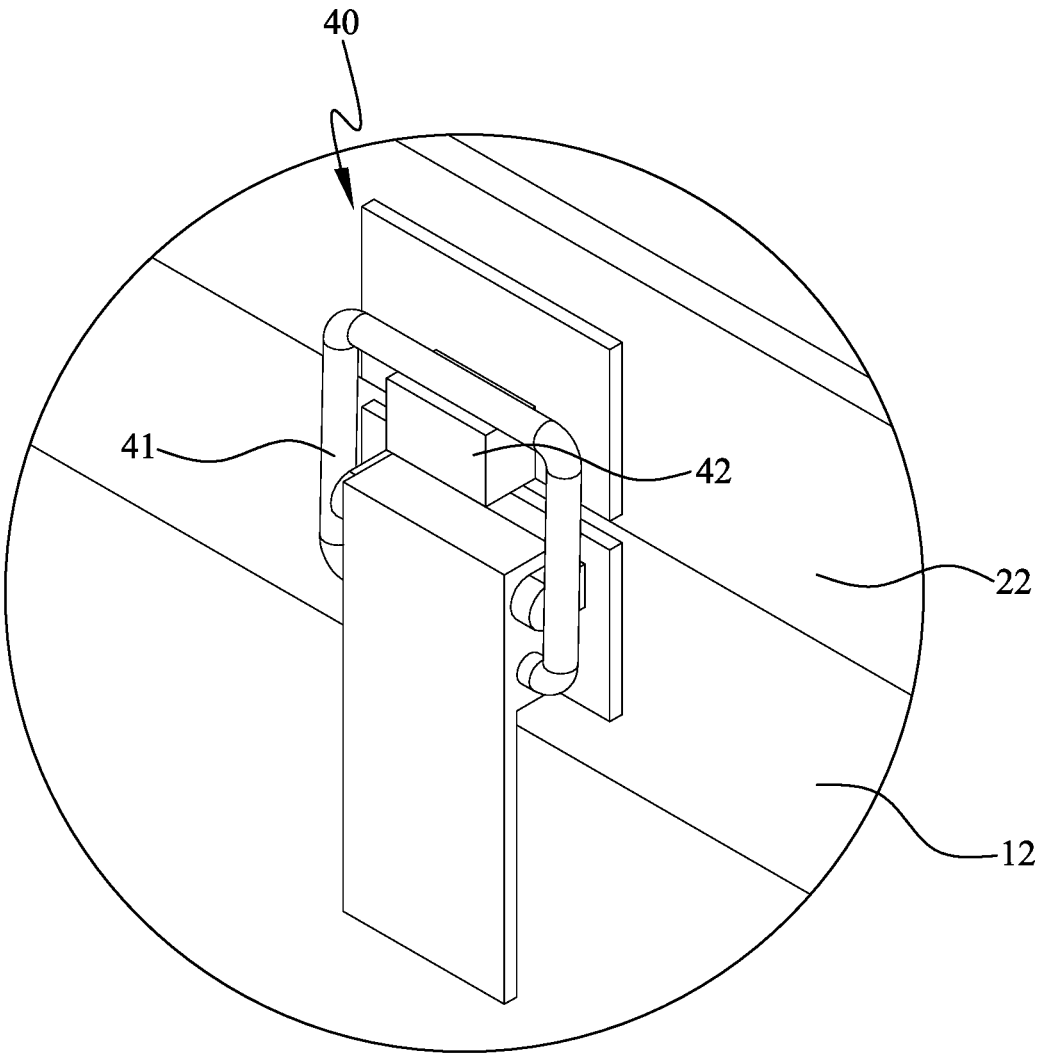
FIG. 8 is an enlarged, fragmentary view showing a fastening structure mounted to the body portion and the cover portion of the cooler box of the present invention.

Please refer to FIGS. 2 and 8. The fastening structure 40 is located between the body portion 10 and the cover portion 20 and includes at least one first fastening member 41 and one second fastening member 42. The first fastening member 41 is selectively connectable to or releasable from the second fastening member 42. As can be seen in FIGS. 2 and 8, the first fastening member 41 is located on a front side of the body portion 10 and fixedly connected to the outer clamping wall portion 123 of the binding frame 12, while the second fastening member 42 is located on a front side of the cover portion 20 and fixedly connected to the outer cover clamping wall portion 221. When the first fastening member 41 is fastened to the second fastening member 42, the cover portion 20 is stopped from being turned via the hinge structure 30 to thereby continuously close the storage opening 112 of the body portion 10, and the storage space 111 is in a closed state and not communicable with an external environment. On the other hand, when the first fastening member 41 is released from the second fastening member 42, the cover portion 20 can be turned open via the hinge structure 30 and the storage space 111 is in an open state and communicable with the external environment. With these arrangements, the fastening structure 40 is able to restrict the cover portion 20 to a closed position to continuously cover the storage opening 112.

The present invention also provides a method for manufacturing the above described cooler box. Please refer to FIGS. 9, 10A and 10B. In an outer shell forming step S1 of the cooler box manufacturing method according to the present invention, a panel 113*c* is installed in a vacuum forming machine 50 and a heating mechanism 51 mounted in the vacuum forming machine 50 starts heating, so that the panel 113*c* is heated by the heating mechanism 51 and becomes softened and deformable in a heating environment of 150-200° C. Then, the softened panel 113*c* is moved in the vacuum forming machine 50 toward a first forming mold 52 mounted in the vacuum forming machine 50 and subjected to a vacuum suction operation, such that the softened panel 113*c* is attached to an outer surface of the first forming mold 52 under a vacuum suction force and forms an outer shell 113. According to a preferred embodiment of the present invention, the panel 113*c* can be made of an ABS resin exclusively, or can be made of an ABS resin and a PC resin.

Figure 9:
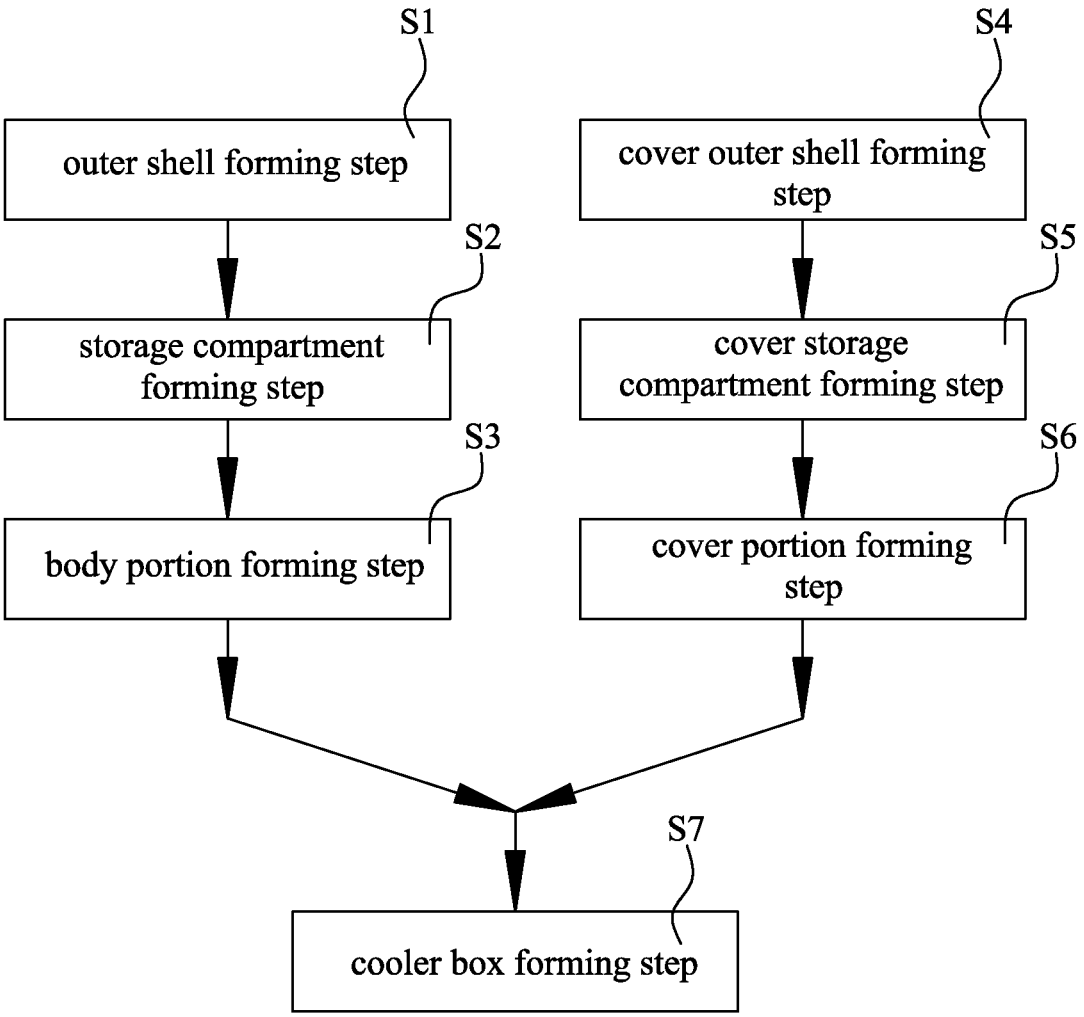
FIG. 9 is a flowchart showing the steps included in a cooler box manufacturing method according to a preferred embodiment of the present invention.
Figure 10A:
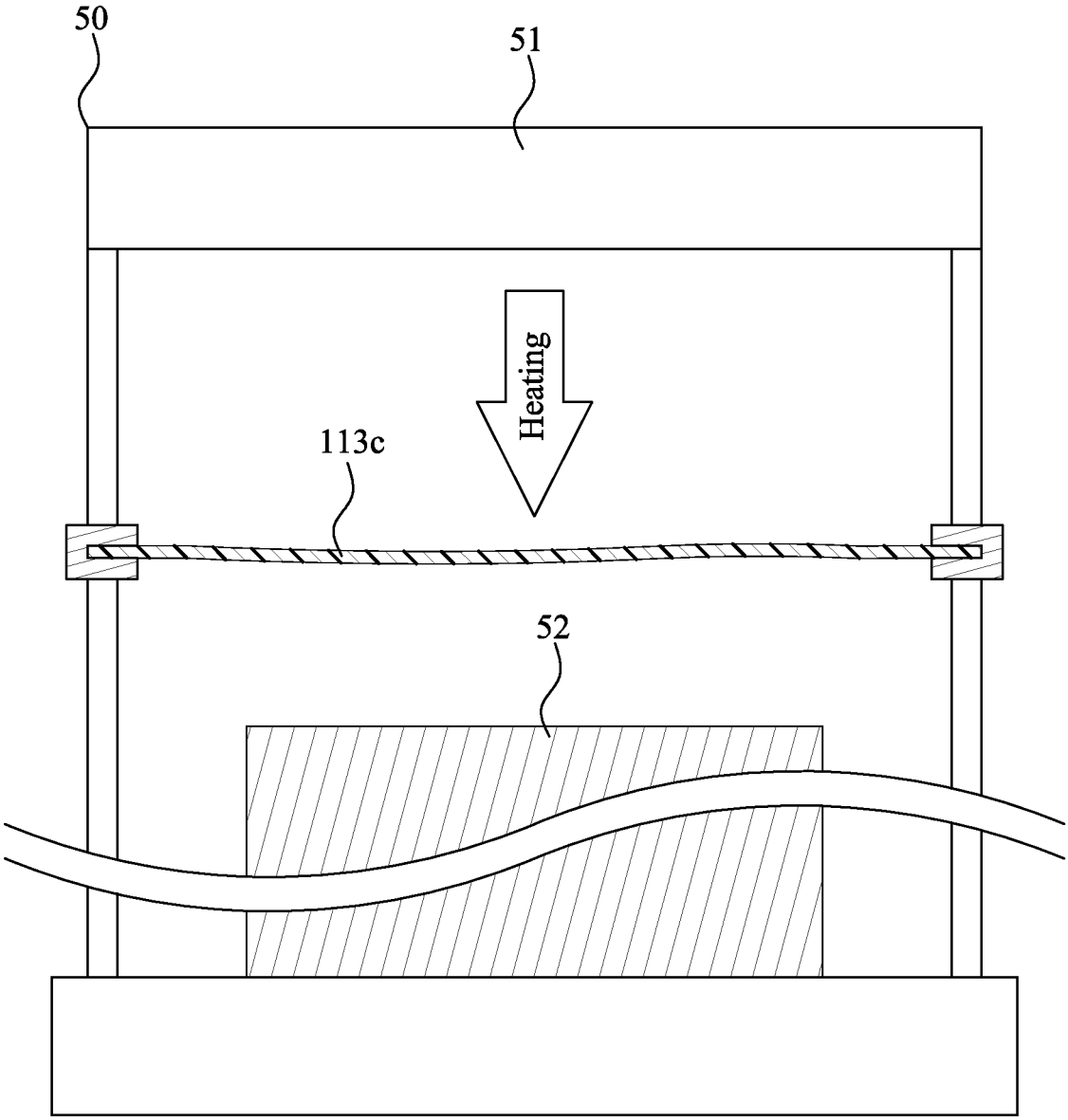
FIGS. 10A and 10B are pictorial descriptions of an outer shell forming step included in the method of the present invention shown in FIG. 9.
Figure 10B:
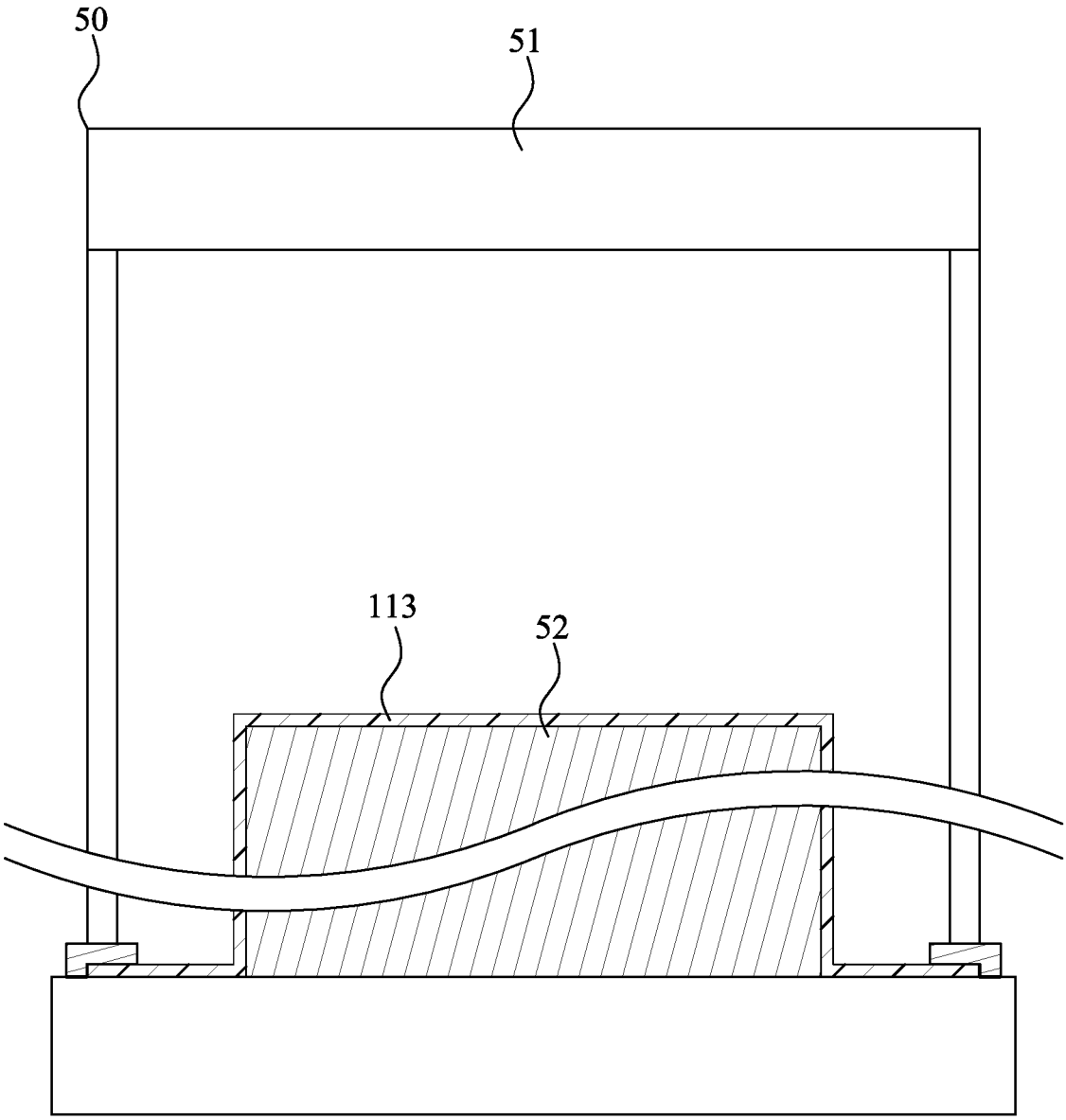
Figure 11:
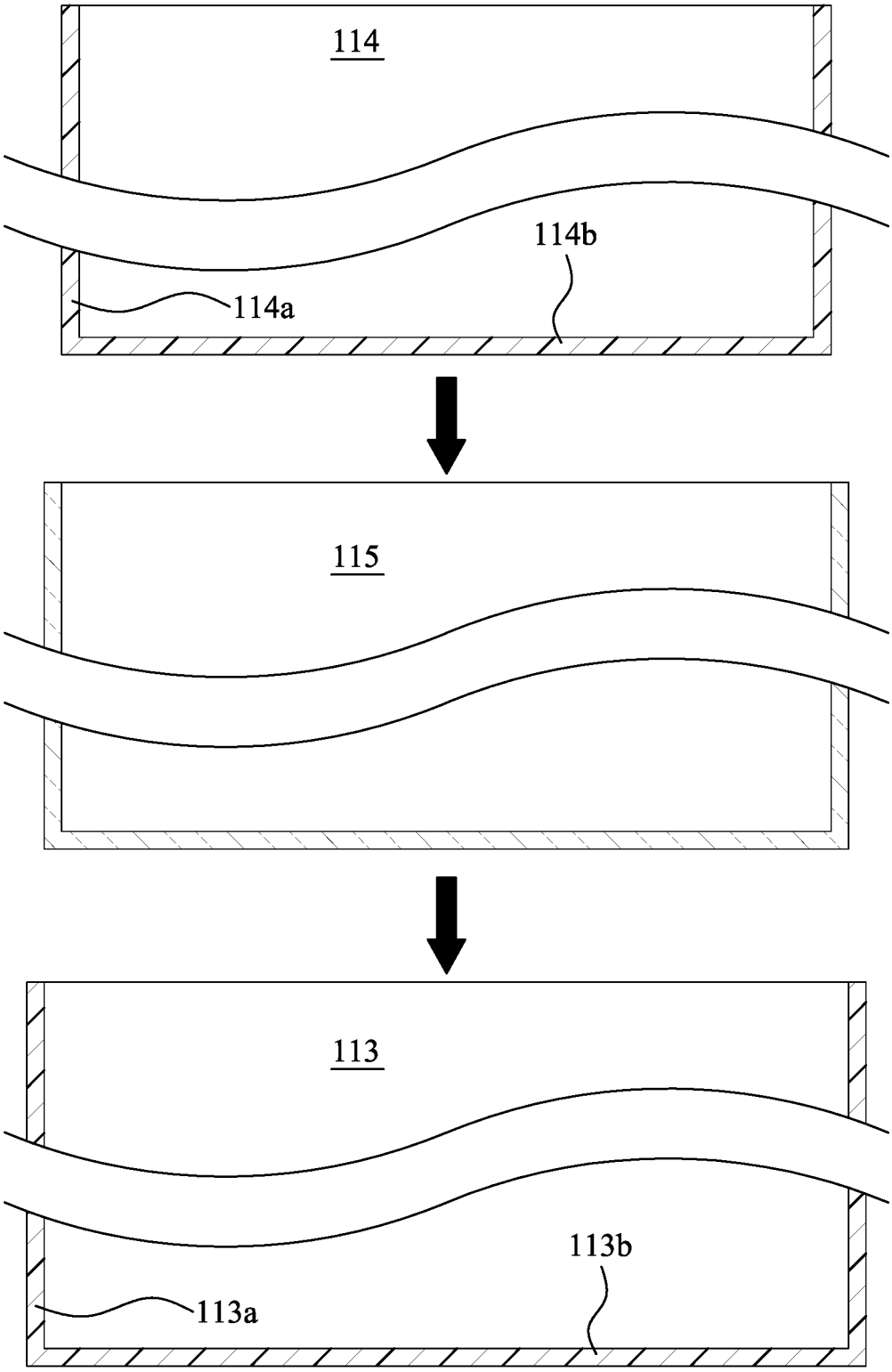
FIG. 11 is a pictorial description of a storage compartment forming step included in the method of the present invention shown in FIG. 9.
Figure 12:
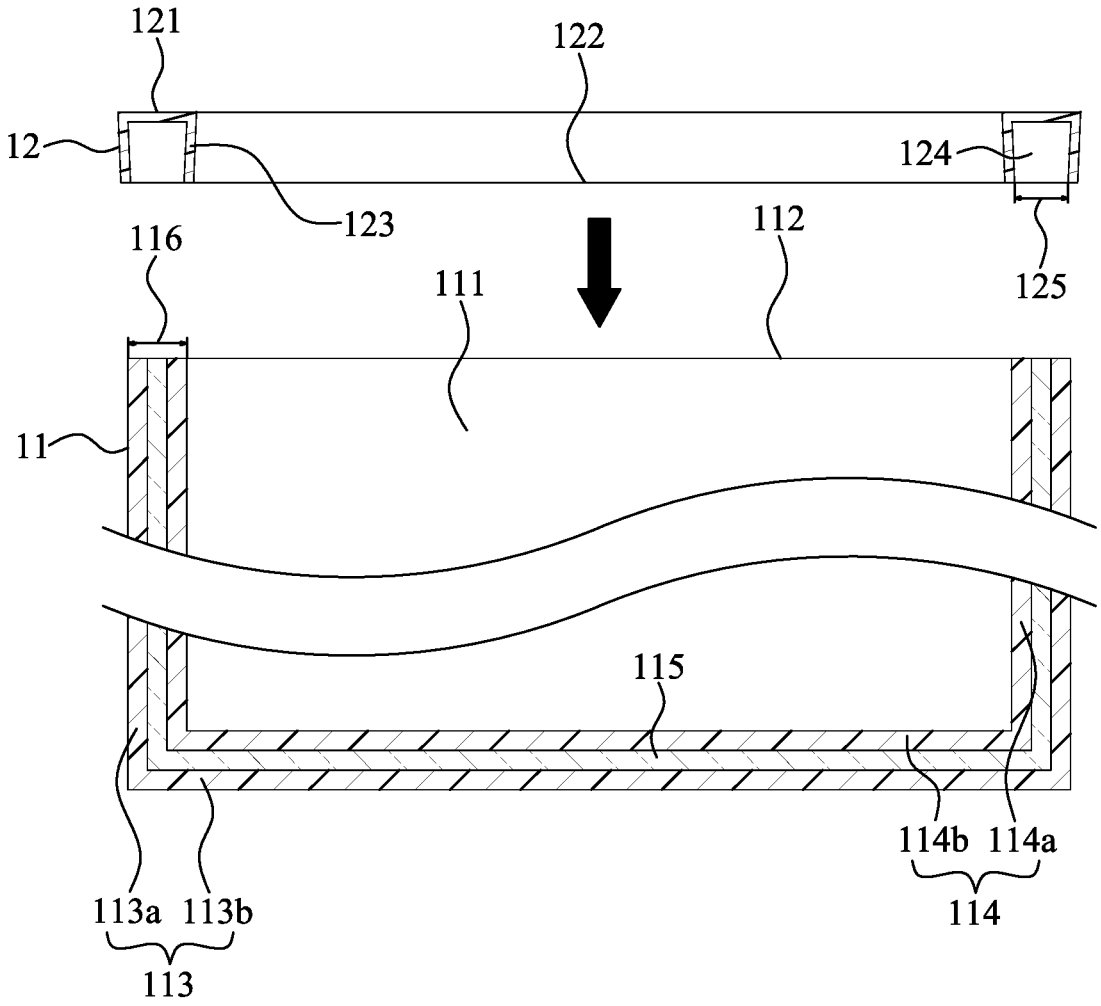
FIG. 12 is a pictorial description of a body portion forming step included in the method of the present invention shown in FIG. 9.

Please refer to FIGS. 9, 11 and 12. After completion of the outer shell forming step S1, a storage compartment forming step S2 starts, in which an insulation layer 115 is positioned on an inner side of the outer shell 113 and an inner shell 114 is further positioned into the outer shell 113, so that the insulation layer 115 is located between the outer shell 113 and the inner shell 114 and a storage compartment 11 having a storage space 111 and a storage opening 112 is formed. Then, a body portion forming step S3 is performed, in which, as shown in FIG. 12, a binding frame 12 is assembled to an upper end of the storage compartment 11, so that an inner and an outer clamping wall portion 123 of the binding frame 12 together inwardly clamp on an outer wall portion 113*a* of the outer shell 113, an inner wall portion 114*a* of the inner shell 114 and the insulation layer 115 with a connecting loop portion 121 of the binding frame 12 being located around the storage opening 112, bringing the storage compartment 11 and the binding frame 12 to assemble to each other and together form a body portion 10 for a cooler box.

Figure 13A:
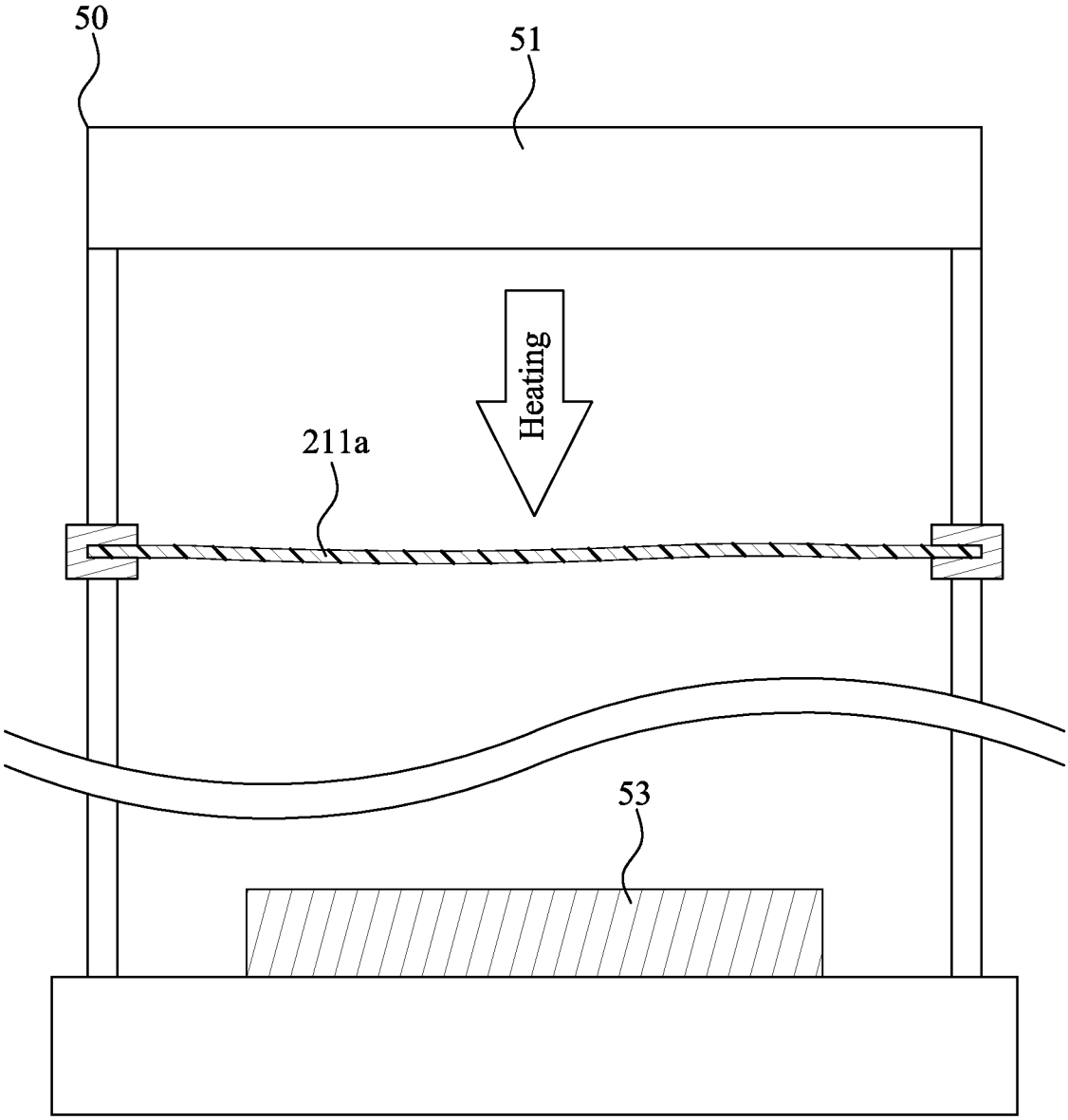
FIGS. 13A and 13B are pictorial descriptions of a cover outer shell forming step included in the method of the present invention shown in FIG. 9.
Figure 13B:
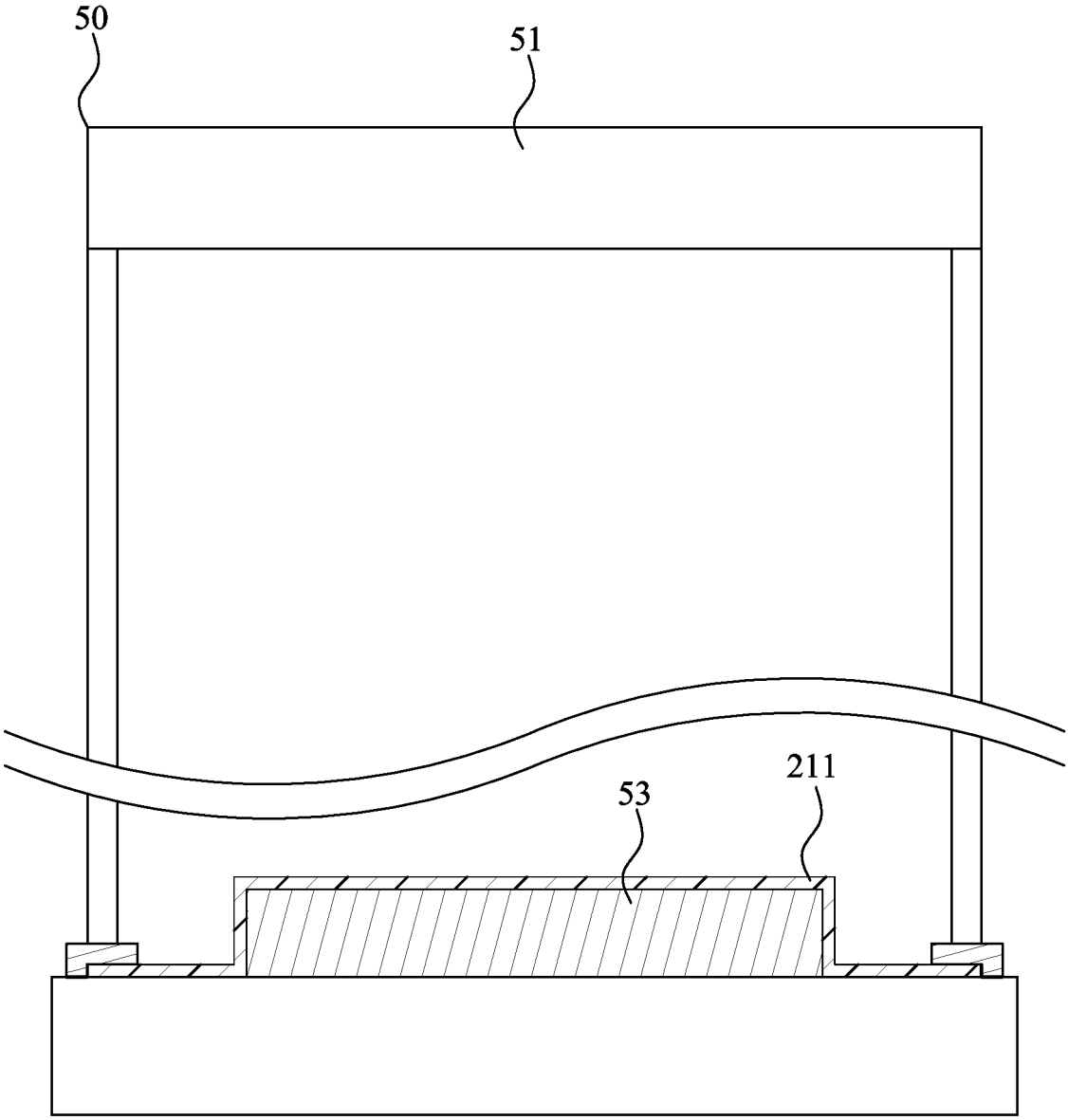

Please refer to FIGS. 9, 13A and 13B. According to the cooler box manufacturing method of the present invention, a cover outer shell forming step S4 can be performed when the outer shell forming step S1 is being performed. In the step S4, a cover panel 211*a* having the same material as the panel 113*c* is installed in a vacuum forming machine 50, and a heating mechanism 51 mounted in the vacuum forming machine 50 starts heating to a temperature ranged between 150 and 200° C., so that the cover panel 211*a* is heated and becomes softened and deformable. Then, the softened cover panel 211*a* is moved in the vacuum forming machine 50 toward a second forming mold 53, which is mounted in the vacuum forming machine 50 and different from the first forming mold 52 in size. The softened cover panel 211*a* is then subjected to a vacuum suction operation to be attached to an outer surface of the second forming mold 53 under a vacuum suction force and forms a cover outer shell 211. Similarly, the cover panel 211*a* can be made of an ABS resin exclusively or be made of an ABS resin and a PC resin.

Figure 14:
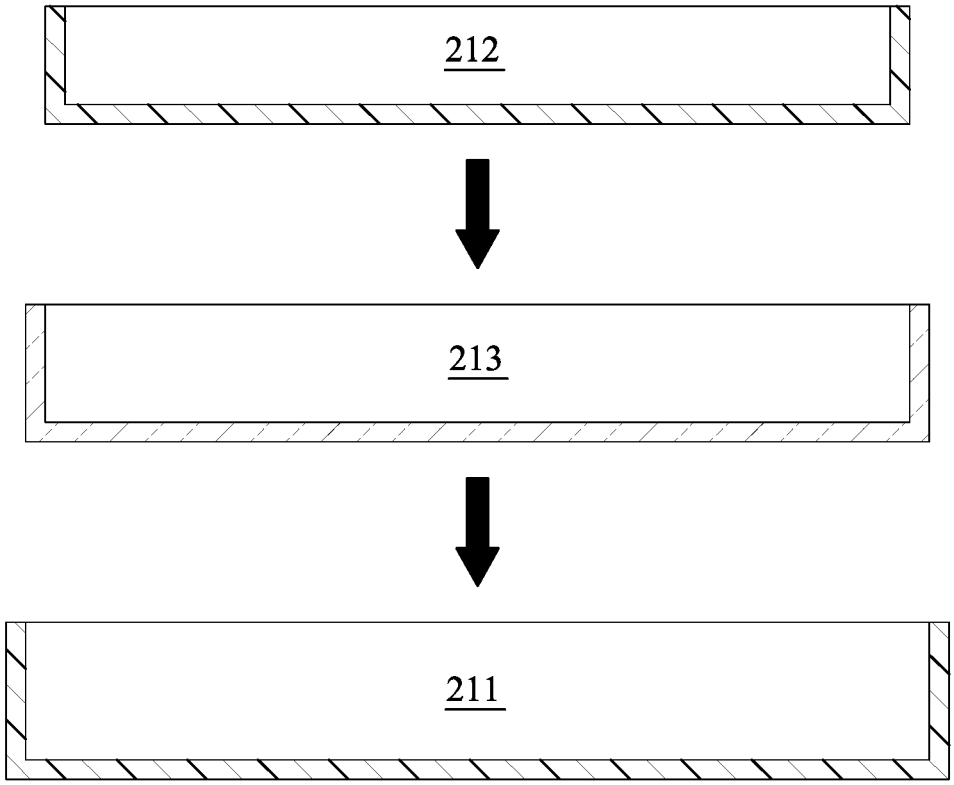
FIG. 14 is a pictorial description of a cover storage compartment forming step included in the method of the present invention shown in FIG. 9.
Figure 15:
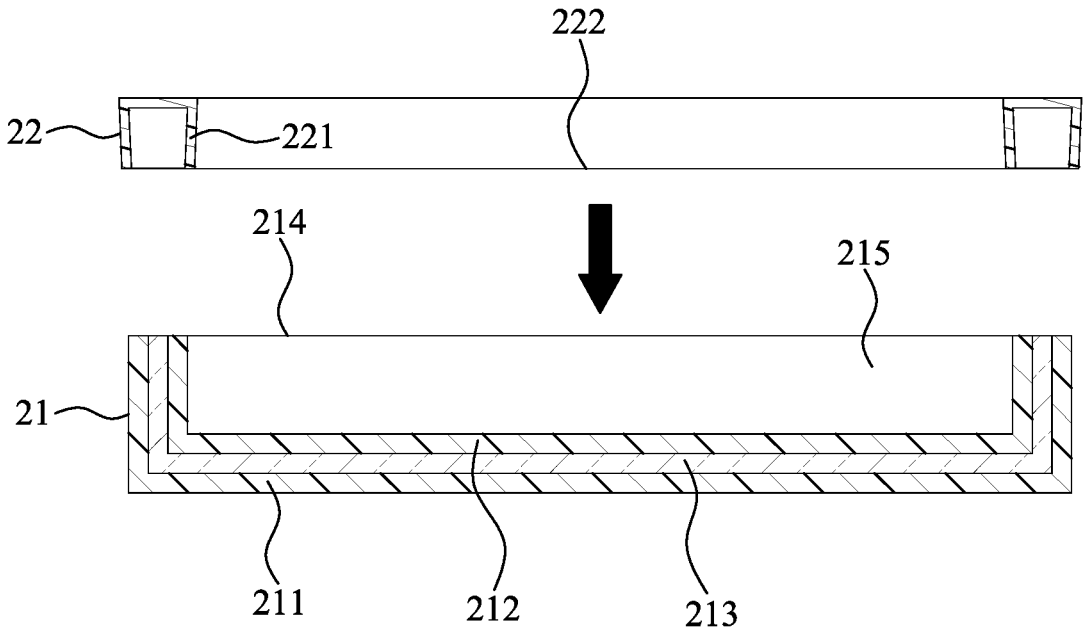
FIG. 15 is a pictorial description of a cover portion forming step included in the method of the present invention shown in FIG. 9.

Please refer to FIGS. 9, 14 and 15. After completion of the cover outer shell forming step S4, a cover storage compartment forming step S5 starts, in which a cover insulation layer 213 and a cover inner shell 212 are sequentially positioned on an inner side of the cover outer shell 211, so that the cover insulation layer 213 is located between the cover outer shell 211 and the cover inner shell 212 and a cover storage compartment 21 having a cover storage space 215 and a cover storage opening 214 is formed. Then, a cover portion forming step S6 is performed, in which, as shown in FIG. 15, a cover binding frame 22 is assembled to the cover storage compartment 21, so that an inner and an outer cover clamping wall portion 221 of the cover binding frame 22 together inwardly clamp on the cover outer shell 211, the cover inner shell 212 and the cover insulation layer 213, bringing the cover storage compartment 21 and the cover binding frame 22 to assemble to each other and together form a cover portion 20 for a cooler box.

Figure 16:
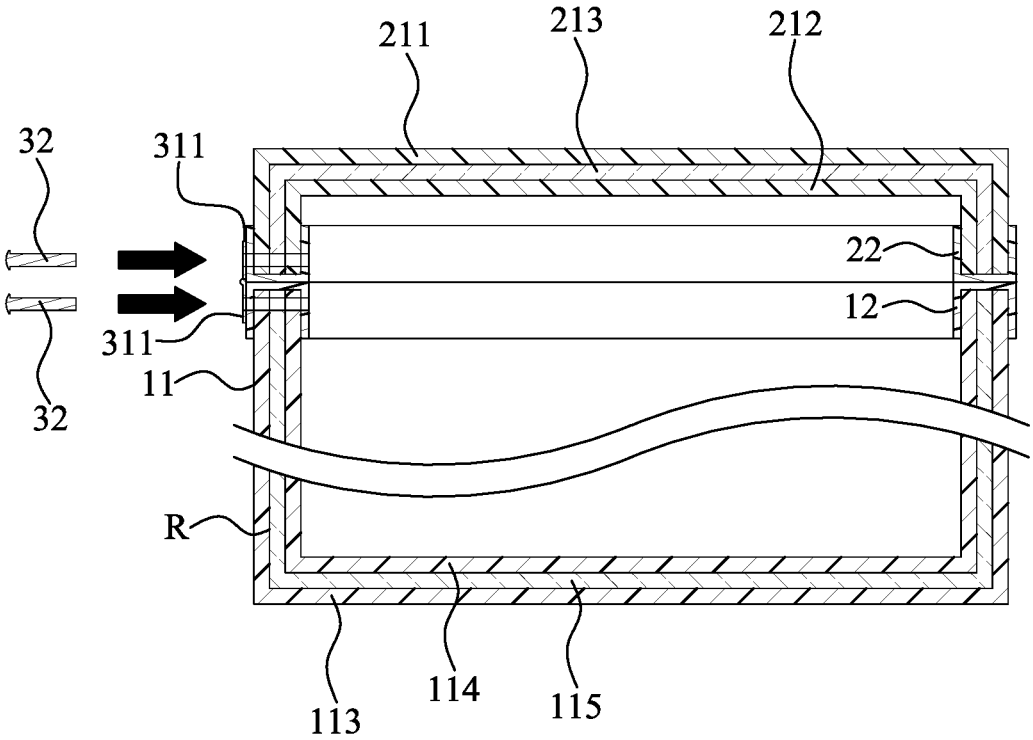
FIG. 16 is a pictorial description of a cooler box forming step included in the method of the present invention shown in FIG. 9.

Please refer to FIGS. 9 and 16. Finally, a cooler box forming step S7 is performed, in which the cover portion 20 is pivotally turnably connected to the body portion 10 via a hinge structure 30 to form a cooler box. More specifically, in the step 7, each of two hinge members 31 of the hinge structure 30 is fixedly connected to the binding frame 12 and the cover binding frame 22 by extending a plurality of insertion pins 32 through one of two leaves 311 of the hinge member 31 sequentially into the outer clamping wall portion 123 of the binding frame 12, the outer shell 113, the insulation layer 115, the inner shell 114 and the inner clamping wall portion 123 of the binding frame 12, and extending another plurality of insertion pins 32 through the other leaf 311 of the hinge member 31 sequentially into the outer cover clamping wall portion 221, the cover outer shell 211, the cover insulation layer 213, the cover inner shell 212 and the inner cover clamping wall portion 221 of the cover binding frame 22.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A cooler box, comprising a body portion and a cover portion; the body portion having a storage opening and internally defining a storage space communicable with the storage opening; the body portion including an inner shell formed in the storage space, an insulation layer located outside the inner shell, and an outer shell located outside the insulation layer; the cover portion being pivotally turnably connected to the body portion via a hinge structure, such that cover portion covers the storage opening to close the storage space; characterized in that:

the body portion further includes a binding frame assembled to an upper end thereof; the binding frame including a connecting loop portion and an inner and an outer clamping wall portion substantially parallelly extending along two opposite lateral edges of the connecting loop portion; the two clamping wall portion together inwardly clamping on the outer shell, the insulation layer and the inner shell while the connecting loop portion being located around the storage opening, such that the insulation layer is fixedly held in an enclosed space defined in between the connecting loop portion, the outer shell and the inner shell.

2. The cooler box as claimed in claim 1, wherein a thickness of an outer wall portion of the outer shell, a thickness of the insulation layer and a thickness of an inner wall portion of the inner shell together define an assembled thickness of the body portion, and wherein the inner and the outer clamping wall portion of the binding frame together define between them a bound thickness, which is smaller than or equal to the assembled thickness.

3. The cooler box as claimed in claim 1, wherein the binding frame is made of an elastic material, such that the inner and outer clamping wall portions of the binding frame are deformable to move away from each other when the binding frame is assembled to the upper end of the body portion around the storage opening.

4. The cooler box as claimed in claim 1, wherein the hinge structure includes at least one hinge member; the hinge member including two leaves pivotally turnably connected to each other, one of the two leaves being fixed to the body portion by a plurality of insertion pins that are extended sequentially through the outer clamping wall portion of the binding frame, the outer shell, the insulation layer, the inner shell and the inner clamping wall portion of the binding frame.

5. A cooler box manufacturing method, comprising:

a storage compartment forming step, in which an insulation layer and an inner shell are sequentially positioned on an inner side of an outer shell to form a storage compartment internally defining a storage space and having a storage opening;

a body portion forming step, in which a binding frame having a connecting loop portion and an inner and an outer clamping wall portion substantially parallelly extended along two opposite lateral edges of the connecting loop portion is assembled to an upper end of the storage compartment, such that the inner and the outer clamping wall portion together clamp on the outer shell, the inner shell and the insulation layer while the connecting loop portion is located around the storage opening, bringing the storage compartment and the binding frame to assemble to each other to form a body portion for a cooler box with the insulation layer fixedly held in an enclosed space defined in between the connecting loop portion, the outer shell and the inner shell; and a cooler box forming step, in which a cover portion is pivotally turnably connected to the body portion via a hinge structure to complete a cooler box.

6. The cooler box manufacturing method as claimed in claim 5, further comprising an outer shell forming step before the storage compartment forming step; and in the outer shell forming step, a panel being heated and becoming softened and deformable, and the softened and deformable panel being then subjected to a vacuum suction operation to form the outer shell.

7. The cooler box manufacturing method as claimed in claim 6, wherein the panel is heated and softened in a processing environment of 150-200° C.

* * * * *